US005626061A

United States Patent [19]

Whitley

[11] Patent Number: 5,626,061

[45] Date of Patent: May 6, 1997

[54] COMPOSITE RATCHET

[75] Inventor: Lowell B. Whitley, Arlington, Tex.

[73] Assignee: Stanley Mechanics Tools, Carrollton, Tex.

[21] Appl. No.: 502,272

[22] Filed: Jul. 13, 1995

[51] Int. Cl.[6] ..... B25B 13/46

[52] U.S. Cl. ..... 81/63; 81/900; 76/114

[58] Field of Search ..... 81/58–63.2, 900; 76/114, 119, 101.1, DIG. 6, DIG. 7; 16/116 R

[56] References Cited

U.S. PATENT DOCUMENTS

| | | | |
|---|---|---|---|
| Re. 34,194 | 3/1993 | Stowell et al. . | |
| 1,965,354 | 7/1934 | Patock | 16/116 R X |
| 2,235,792 | 3/1941 | Bauman | 16/116 R |
| 2,522,579 | 9/1950 | Le Rette . | |
| 2,798,248 | 7/1957 | Sladky et al. . | |
| 3,078,973 | 2/1963 | Kilness . | |
| 3,393,587 | 7/1968 | Jolliff et al. . | |
| 3,656,594 | 4/1972 | Marks et al. . | |
| 3,908,487 | 9/1975 | Plaw | 81/59.1 |
| 4,070,932 | 1/1978 | Jeanotte . | |
| 4,277,989 | 7/1981 | Tracy . | |
| 4,277,990 | 7/1981 | Hall . | |
| 4,308,769 | 1/1982 | Rantanen . | |
| 4,488,460 | 12/1984 | Ballone et al. . | |
| 4,639,029 | 1/1987 | Kolonia . | |
| 4,770,072 | 9/1988 | Neuhaus . | |
| 4,841,597 | 6/1989 | Kolonia . | |
| 4,986,147 | 1/1991 | Cooper | 81/63.2 |
| 5,020,398 | 6/1991 | Leu . | |
| 5,211,669 | 5/1993 | Bonnes et al. . | |
| 5,271,300 | 12/1993 | Zurbuchen et al. . | |
| 5,511,445 | 4/1996 | Hildebrandt | 16/116 R X |

*Primary Examiner*—D. S. Meislin

*Attorney, Agent, or Firm*—Gregory M. Howison; Mark W. Handley; Joseph Shallenburger

[57] ABSTRACT

The present invention comprises a reversible drive ratchet wrench (10). A formed metallic insert (50) is provided. The reversible drive ratchet wrench (10) has a length, a head (14), including a ratchet mechanism (36) and a handle (16). A formed metallic insert (50) has an opening (28) for insertion of a ratchet mechanism (36). The formed metallic insert (50) also extends along the handle (16) of the wrench (10). A non-metallic covering (13) is molded around the metallic insert (50), encapsulating the head and entire length of the metallic insert (50), except for the interior of the opening (28). The non-metallic covering (13) is injection-molded around the metallic insert (50). The non-metallic covering (13) has a low dielectric value and may comprise glass fibers distributed longitudinally and/or nylon or copolymers. A non-metallic covering (13) may be of uniform thickness or varying thickness. The reversing lever (18) may also be made of the composite material.

60 Claims, 3 Drawing Sheets

COMPOSITE RATCHET

TECHNICAL FIELD OF THE INVENTION

The present invention relates to a ratchet wrench formed of a composite material, and more particularly, to a ratchet wrench formed of a composite material with an insert imbedded within the handle.

BACKGROUND OF THE INVENTION

Conventionally, wrenches and similar hand tools have been made of iron, steel or some other metal, because of strength and durability requirements. Metal tools are manufactured using casting or forming procedures. The important disadvantage of metal tools is their cost, both from manufacturing and material standpoints. Moreover, metal tools are unsuitable for use in many applications, particularly when a shock hazard condition exists.

Hand tools have been proposed which include both metal and non-metallic substances, the non-metal substances generally forming the handles, or lower-stress receiving portions of the tool. Although this results in a reduced cost from a material standpoint, the presence of metal limits the use of the tool. Some hand tools have been proposed which are made entirely of a non-metallic material. However, such hand tools have found limited applications due to the strength requirements for the work-receiving portions of the hand tool. Accordingly, for the most part, the use of non-metallic in tools has been limited to low-torque wrenches and low-strength pliers, and the like, where high stress factors are not encountered in use.

There is a need for wrenches and other hand tools which are non-metallic and therefore, non-magnetic, non-conductive non-sparking. These wrenches should be made of low-cost materials, and which are inexpensive to manufacture, but yet have strength comparable to that of a metal tool of comparable size.

Ratchet wrenches with bodies or body components comprised of non-metallic materials are known in the art, and such tools have taken various forms and structural arrangements. In some of these tools, mechanical strength has been sacrificed or compromised to achieve weight reduction and to reduce production costs. In others, the option of plastic as a structural medium has not been without the sacrificing of durability and functional reliability. The recognized advantages inherent in the adoption of non-metals as a structural medium in the fabrication of tools such as ratchet wrenches notwithstanding, no completely satisfactory composite structure assembly has heretofore been devised.

SUMMARY OF THE INVENTION

The present invention disclosed and claimed herein comprises a reversible drive ratchet wrench. The ratchet wrench has a head and a handle. A single piece insert is provided for forming both a supportive portion of the head and a supportive portion of the handle and having a thickness substantially less than the overall thickness of the head of the ratchet, the head portion forming a cup having an opening for the ratchet mechanisms. A non-metallic material covering is provided which is molded around the formed metallic insert and encapsulating the insert. The non-metallic material may be a composite. The entire length of the insert is covered, leaving the interior of the opening for the ratchet mechanism. The insert may be made of metal. The insert may have a uniform or varying thickness. The cross-sectional shape of the insert is concave. The most distal end of the insert is smaller than the head with a narrow neck disposed between the distal end and the cup. The composite non-metallic covering may be injection or compression molded around the insert. The composite non-metallic covering may have a low dielectric value. Glass fibers may be distributed in the non-metallic covering in a longitudinal fashion. The composite non-metallic material may comprise a nylon, carbon or a copolymer. The composite covering may be uniform in thickness and vary between 0.075 inches thick and 0.090 inches or may vary greatly in thickness.

In another aspect of the present invention, a reversing switch that is utilized in conjunction with the ratchet mechanism is made of a composite material.

In yet another aspect of the present invention, the composite non-metallic covering is smooth or textured. The composite may have a rubberized coating over the composite covering.

In a further aspect of the present invention, the rubberized surface is inlaid in the composite non-metallic covering, and molded over the composite non-metallic covering or bonded to the composite non-metallic covering.

The use of composite materials with low dielectric or strength provide an insulation between the user and the working end of the ratchet when operating in an electrical environment.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
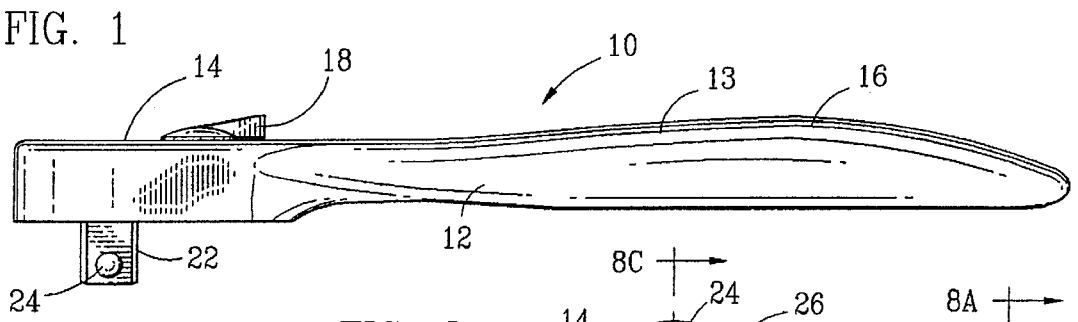
FIG. 1 illustrates a side elevation view of the ratchet wrench of the present invention.

Referring now to FIG. 1, there is illustrated a side elevation view of the ratchet wrench of the present invention. A reversible drive ratchet wrench 10 is provided. The wrench 10 consists of a unitary body 12 and a head 14. A handle 16 is also provided connected to the unitary body 12. The wrench also consists of a ratchet assembly (not shown) and a formed metallic insert (not shown). The ratchet mechanism (not shown) is disposed in the head 14 of the wrench 10. Protruding from the ratchet mechanism is a square tang 22. A detent ball 24 is embedded in the tang 22. A reversing lever 18 is attached to the top of the head 14 of the wrench 10. The tang 22 and the detent ball 24 are used to engage tools such as socket heads and the like.

The head 14, unitary body 12 and handle 16 are all formed of a moldable non-metallic or a composite material 13. The composite material 13 is compression or injection-molded around a metallic insert (not shown). The handle 16 is shaped to achieve an "ergonomic" grip style, which may incorporate a smooth or textured surface. The handle 16 may be contoured. The handle 16 may also have a rubberized layer inlaid, molded over or bonded onto the surface to improve the grip. The ratchet drive tang 22 could be of any size and could consist of, but is not limited to, the ¼ inch, ⅜ inch and ½ inch drives. The handle 16 may vary in size according to the ratchet drive size.

The composite material 13 also promotes non-conductivity. The handle 16, the unitary body 12 and the head 14 are all formed of the composite material 13 which has a low dielectric value, thus reducing the risk of shock if the handle 16 makes contact with an electric source. The reversing lever 18 may also be made of the composite material 13 with a low dielectric value, thereby further insulating the user from risk of electric shock. Glass fibers may be added to the composite material 13 along the longitudinal direction to add strength to the composite material 13. The composite material 13 may consist of a nylon, carbon or copolymer material. The material used in this embodiment is VERTON® RF-700-10-HS, manufactured by LNP Engineering Plastics, Inc., 475 Creanery Way, Exton, Pa. 19341.

Figure 2:
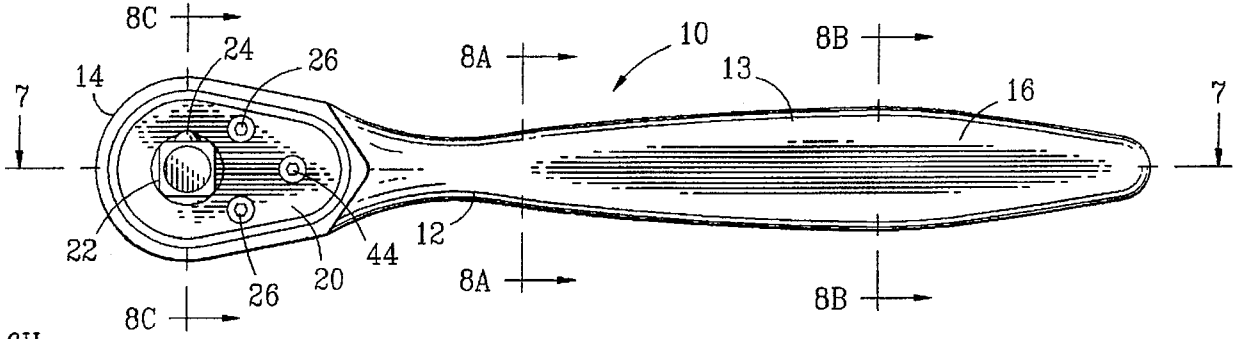
FIG. 2 illustrates an elevational view of the bottom of the wrench.

Referring now to FIG. 2, there is illustrated an elevational view of the bottom of the wrench 10. The wrench 10 is shown having the head 14 connected to the unitary body 12 and the handle 16. A clamp plate 20 is shown attached to the head 14 to contain the ratchet mechanism (not shown). The clamp plate 20 is held in place with two headed bolts 26. The tang 22, having the detent ball 24, is shown protruding through the clamp plate 20. The head 14 and the body 12 have a low profile, but the handle 16 has a higher profile.

Figure 3:
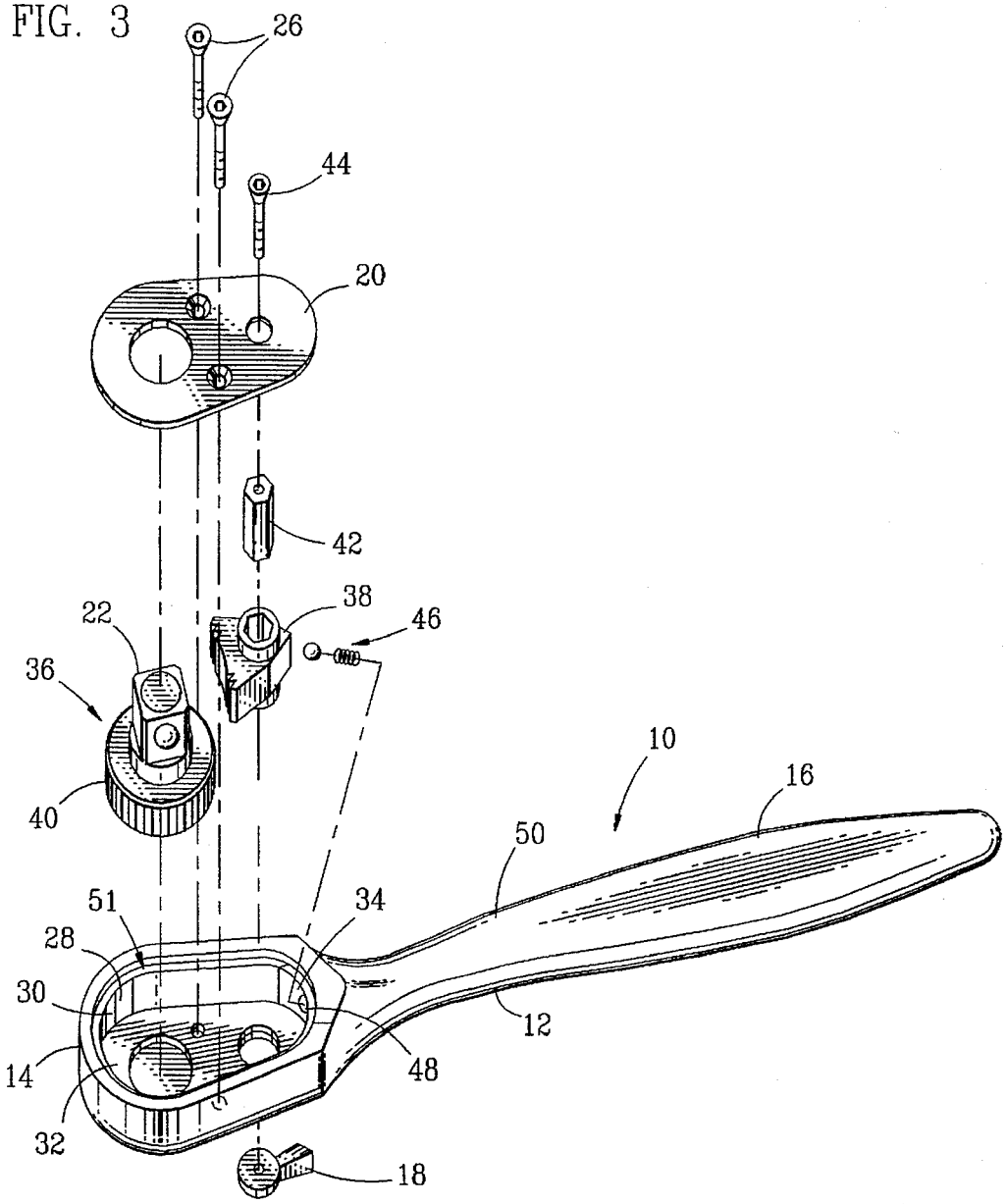
FIG. 3 illustrates an exploded, perspective view showing the structure and components of the wrench.

Referring now to FIG. 3, there is illustrated an exploded, perspective view showing the structure and components of the wrench 10. The wrench 10 is shown with handle 16, unitary body 12 and head 14. An opening 28 is provided in the head 14 of the wrench 10. The walls 30 and the base 32 of opening 28 are formed by a head portion 51 of the metallic insert 50. The rear portion 34 of opening 28 is formed by the composite material 13 of the head 14.

The ratchet mechanism 36 consists of a pivotally-mounted, shiftable, toothed pawl 38 and a cooperating, externally-toothed, drive wheel 40. The drive wheel 40 is integrally formed with or otherwise firmly joined to the tang 22, which projects laterally outwardly from the drive wheel 40. The reversing lever 18 is keyed to the pawl 38 through a shaft 42. The shaft 42 is connected to the reversing lever 18 using reversing lever screw 44. This allows the pawl 38 to be manipulated using the reversing lever 18 which, in turn, may be manipulated by the finger of the operator. The reversing lever 44 controls the drive direction of the wrench 10.

A spring and ball assembly 46 is disposed in the spring hole 48, which is disposed in the composite rear portion 34 of the opening 28 of the head 14. The spring and ball assembly 46 is confined by the spring hole 48 and bears upon the pawl 38 to retain it in either of its two functional drive modes. The clamp plate 20 is attached to the head 14 of wrench 10, using the headed bolts 26. The clamp plate 20 keeps the ratchet mechanism 36 in place. The clamp plate 20 is set into a recessed area such that the top face of clamp plate 20 is co-planar with the upper edges of the head 14 of the wrench 10.

Figure 4:
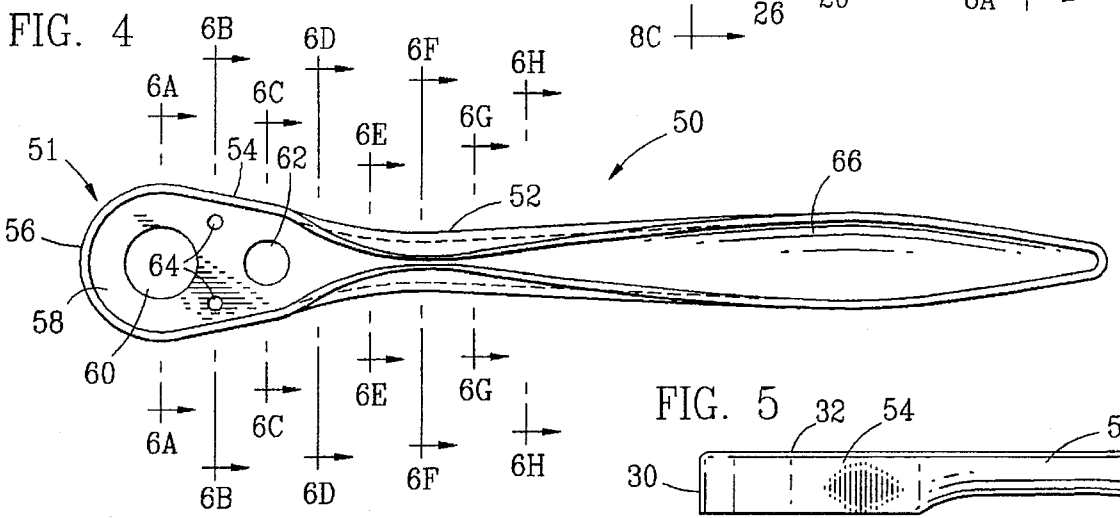
FIG. 4 illustrates a top elevational view of the insert.

Referring now to FIG. 4, there is illustrated a top elevational view of the formed metallic insert 50. The formed metallic insert 50 extends the full length of the wrench and is encapsulated within the composite material 13. The metallic insert 50 is the primary load-bearing surface between the ratchet mechanism 36 and the handle 16. The metallic insert 50 also provides reinforcement for the handle 16. The metallic insert 50 is formed using a stamping process and is made of a low carbon steel. The metal forming the metallic insert 50 maybe of equal thickness or varying thickness throughout its length. This allows flexibility and lower costs in manufacturing. The metallic insert 50 acts as a spline for the wrench 10.

The formed metallic insert 50 has a thin neck portion 52. This allows the head 14 of the wrench 10 to be feathered back and forth. The head 54 of metallic insert 50 is shaped to receive the ratchet mechanism 36, as shown in FIG. 3. The head 54 is formed by a wall 30 surrounding the outer perimeter of the head 54. A base 32 is provided perpendicular to the wall 30. The base 32 has two holes disposed therein, the mechanism hole 60 and the pawl hole 62. There are also two bolt holes 64 disposed in the base 32 of the head 54 of the metallic insert 50. The mechanism hole 60 is for receiving the side of the drive wheel 40 opposite the tang 22. When an upper portion 68 of the drive wheel 40 rests in hole 60, the drive wheel is kept in place, and is only allowed rotational movement. The pawl hole 62 is for receiving the shaft 42, which is used to move the pawl 38, as shown in FIG. 3. The bolt holes 64 are used for receiving the headed bolts 26, as shown in FIG. 3. When assembled, the headed bolts 26 are threadedly engaged with bolt holes 64. The neck 52 of the metallic insert 50 is narrower than the head 54. The handle 66 of the metallic insert 50 is wider than the neck 52, but not as wide as the head 54. The rear portion of the handle 66 tapers such that it is narrower than the mid-point of the handle 66.

Figure 5:
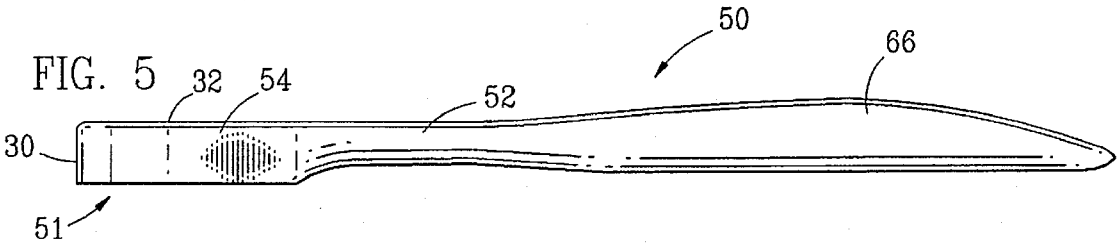
FIG. 5 illustrates a side elevational view of the insert.

Referring now to FIG. 5, there is illustrated a side elevational view of the metallic insert 50. The head 54 of metallic insert 50 is shown, having the base 32 and the wall 30. The neck 52 and the handle 66 are also shown. The neck 52 and head 64 have a low profile, and the handle 66 has a higher profile.

Figure 6A:
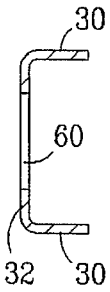
FIGS. 6A–6H illustrate cross-sectional views taken along lines 6A—6A through 6H—6H of FIG. 4.

Referring now to FIGS. 6A-6H, there are illustrated cross-sectional views taken along lines 6A—6A through 6H—6H of FIG. 4. FIG. 6A illustrates a cross-sectional view taken along line a—a of FIG. 4 of the widest part of the head 54 of the metallic insert 50. The cross-section is a square C-shaped cross-section. Walls 30 and base 32 of head 54 of metallic insert 50 are shown. The walls 30 are flat and form a 90° angle with the base 32, which is also flat. The mechanism hole 60 is shown disposed in base 32.

Figure 6B:
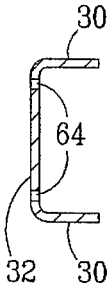

FIG. 6B illustrates a cross-sectional view taken along line 6B'6B of FIG. 4. The cross-section of the metallic insert 50 is the same shape as shown in FIG. 6A, but has a slightly smaller width. The walls 30 are still perpendicular to base 32. Bolt holes 64 are shown disposed in base 32.

Figure 6C:
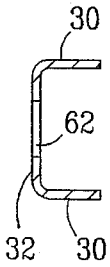

Referring now to FIG. 6C, there is illustrated a cross-sectional view of the metallic insert 50, taken along line 6C—6C of FIG. 4. The width of the cross-section shown in FIG. 6*c* is slightly less than that shown in FIG. 6B. Walls 30 are still perpendicular to base 32. Pawl hole 62 is shown disposed in base 32.

Figure 6D:
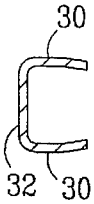

Referring now to FIG. 6D, there is illustrated a cross-sectional view taken along line 6D—6D of FIG. 4. The cross-section is still C-shaped, but the ends of the walls 30 are turned inwards toward each other. This causes the walls 30 not to be fully perpendicular to base 32. Also, the width of the cross-section is less than the width of the cross-section shown in FIG. 6C.

Figure 6E:
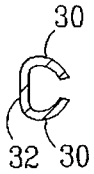

Referring now to FIG. 6E, there is illustrated a cross-sectional view taken along line 6E—6E of FIG. 4. The walls 30 of the metallic insert 50 are turned towards each other such that the cross-section is now in the shape of a rounded "C".

Figure 6F:
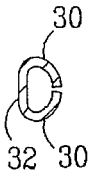

Referring now to FIG. 6F, there is illustrated a cross-sectional view taken along line 6F—6F. In this illustration, the sides of the metallic insert 50 have been turned in towards each other such that they are almost touching. The base 32 is still flat, but the walls 30 are curved.

Figure 6G:
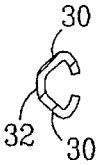

Referring now to FIG. 6G, there is illustrated a cross-sectional view taken along line 6G—6G of FIG. 4. In this cross-section, the walls 30 have been bent such that they contain an angle. The ends of walls 30 are further apart than in FIG. 6F. The shape of the cross-section is similar to an elongated hexagon with one side missing opposite the base 32.

Figure 6H:
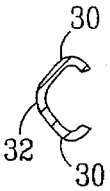

Referring now to FIG. 6H, there is illustrated a cross-sectional view taken along line 6H—6H of FIG. 4. In FIG. 6H, base 32 no longer has a flat portion but is curved to form a parabola, and the two portions of base 32 form approximately a 90° angle with each other. The walls 30 are turned towards each other at approximately a 90° angle to the base 32. The ends of the walls 30 are further apart from each other than in FIG. 6G. The cross-section of the rest of the handle 66 are all of parabolic shapes with varying widths, with the cross-sections near the middle of the handle 66 wider than the cross-sections at each end of handle 66.

Figure 7:
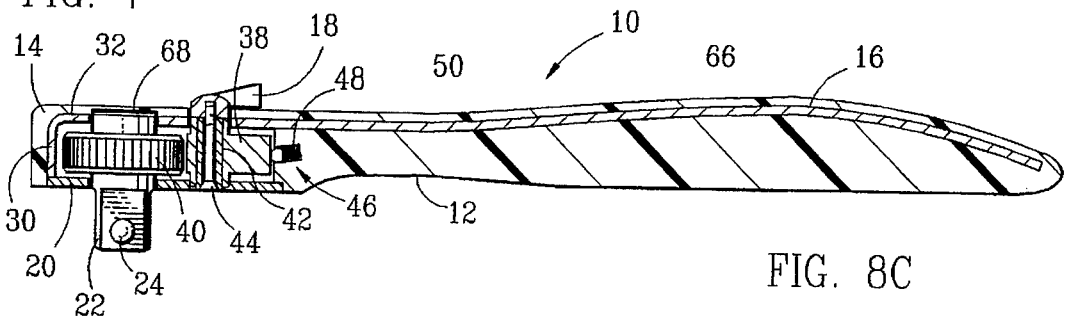
FIG. 7 illustrates a cross-sectional view taken along line 7—7 of FIG. 2.

Referring now to FIG. 7, there is illustrated a cross-sectional view taken along line 7—7 of FIG. 2. The formed metallic insert 50 is shown with the unitary body 12 comprising the composite material 13 attached to the formed metallic insert 50. The handle 16 is shown and is made of the composite material 13. The handle 66 of the metallic insert 50 is also shown running through the handle 16 of the wrench 10. The spring and ball assembly 46 is shown disposed in the spring hole 48. The pawl 38 is shown being held in place by the shah 42. The shaft 42 in turn is held in place by reversing lever screw 44, which passes from the clamp plate 20 through the shaft 42, through the pawl 38 through the metallic insert 50, through the head 14 and is threadadly engaged with the reversing lever 18.

The drive wheel 40 is shown with the tang 22 attached to the drive wheel 40. The detent ball 24 is shown disposed in the tang 22. The upper portion 68 of the drive wheel 40 is shown passing through the base 32 of the metallic insert 50. The upper portion 68 then rests in the head 14 which is formed of the composite material 13. Wall 30 abuts against clamp plate 20. The head 14 covers the intersection of the wall 30 and the clamp plate 20 such that the edge of the head 14 is coplanar with the clamp plate 20.

Figure 8A:
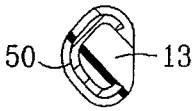
FIG. 8A illustrates a cross-sectional view along the line 8A—8A of FIG. 2.

Referring now to FIG. 8A, there is illustrated a cross-sectional view along the line 8A—8A of FIG. 2. The formed metallic insert 50 is shown having a parabolic shape with the ends bent towards each other. The composite material 13 is shown filling the area inside the parabola formed by the metallic insert 50 and also the area around the outside of the metallic insert 50. The composite material 13 forms a shape resembling a rounded triangle around the metallic insert 50.

Figure 8B:
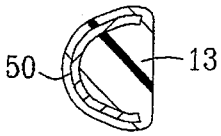
FIG. 8B illustrates a cross-sectional view along the lines 8B—8B of FIG. 2.

Referring now to FIG. 8B, there is illustrated a cross-sectional view along the lines 8B—8B of FIG. 2. The metallic insert 50 is formed in the shape of a parabola with the ends bent towards each other. The composite material 13 is formed in the shape of a rounded triangle around the parabola-shaped metallic insert 50.

Figure 8C:
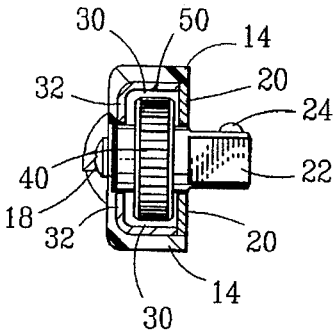
FIG. 8C illustrates a cross-sectional view taken along the lines 8C—8C of FIG. 2.

Referring now to FIG. 8C, there is illustrated a cross-sectional view taken along the lines 8C—8C of FIG. 2. The head 14 is shown and is made of the composite material 13. The metallic insert 50 is shown having the walls 30 and the base 32 disposed adjacent to the head 14. The drive wheel 40 is shown disposed inside the head 14 with its upper portion 68 protruding through the base 32 of the metallic insert 50 to abut against the head 14. The clamp plate 20 is shown abutting against the walls 30 of the metallic insert 50 on one side and on the end against the head 14. The tang 22 is shown protruding through the clamp plate 20.

Figure 9:
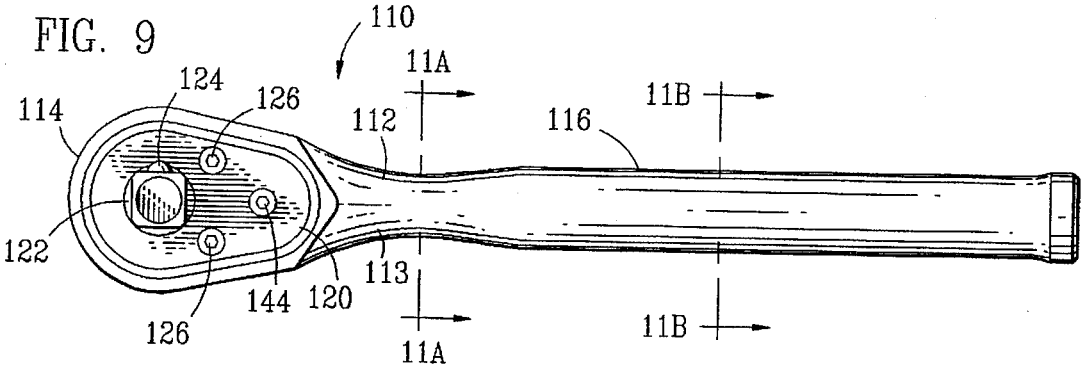
FIG. 9 illustrates an elevational view of the bottom of an alternate embodiment of the system of the present invention.

Referring now to FIG. 9, there is illustrated an elevational view of an alternate embodiment of the system of the present invention. A reversible drive ratchet wrench 110 is provided. The wrench 110 consists of a unitary body 112 and a head 114. A handle 116 is also provided connected to the unitary body 112. The wrench also consists of a ratchet assembly (not shown) and a formed metallic insert (not shown). The ratchet mechanism (not shown) is disposed in the head 114 of the wrench 110. Protruding from the ratchet mechanism is a square tang 122. A detent ball 124 is embedded in the tang 122. The tang 122 and the detent ball 124 are used to engage tools such as socket heads and the like.

The head 114, unitary body 112 and handle 116 are all formed of a moldable non-metallic or composite material 113. The composite material 113 is compression or injection-molded around a metallic insert (not shown). The handle 116 is shaped to achieve an "ergonomic" grip style, which may incorporate a smooth or textured surface. The handle 116 may be contoured. The handle 116 may also have a rubberized layer inlaid, molded over or bonded onto the surface to improve the grip. The ratchet drive tang 122 could be of any size and could consist of, but is not limited to, the ¼ inch, ⅜ inch and ½ inch drives. The handle 116 may vary in size according to the ratchet drive size.

The composite material 113 also promotes non-conductivity. The handle 116, the unitary body 112 and the head 114 are all formed of the composite material 113 which has a low dielectric value, thus reducing the risk of shock if the handle 16 makes contact with an electric source. A reversing lever (not shown) may also be made of the composite material 113 with a low dielectric value, thereby further insulating the user from risk of electric shock. Glass fibers may be added to the composite material 113 along the longitudinal direction to add strength to the composite material 113. The composite material 113 may consist of a nylon, carbon or copolymer material. The material used in this embodiment is VERTON® RF-700-10-HS, manufactured by LNP Engineering Plastics, Inc., 475 Creanery Way, Exton, Pa. 19341.

The wrench 110 is shown having the head 114 connected to a unitary body 112 and the handle 116. A clamp plate 120 is shown attached to the head 114 to contain the ratchet mechanism (not shown). The clamp plate 120 is held in place with two headed bolts 126. The tang 122, having the detent ball 124, is shown protruding through the clamp plate 120. The head 114 and the body 112 have a low profile, but the handle 16 has a higher profile.

Figure 10:
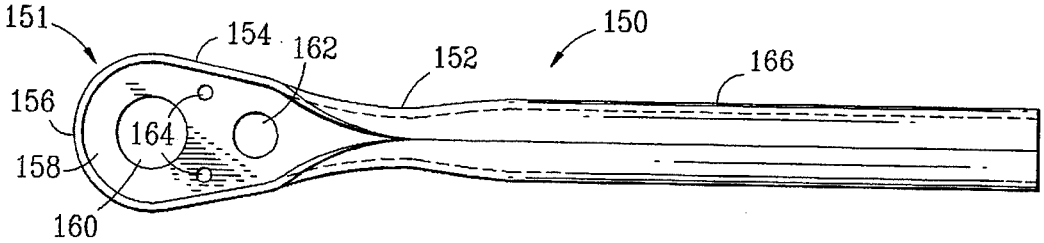
FIG. 10 illustrates a top elevational view of the formed metallic insert of an alternate embodiment of the system of the present invention.

Referring now to FIG. 10, there is illustrated a top elevational view of the formed metallic insert 150. The formed metallic insert 150 extends the full length of the wrench and is encapsulated within the composite material 113. The metallic insert 150 is the primary load-beating surface between the ratchet mechanism and the handle 116. The metallic insert 150 also provides reinforcement for the handle 116. The metallic insert 150 is formed using a stamping process and is made of a low carbon steel. The metal forming the metallic insert 150 maybe of equal thickness or varying thickness throughout its length. This allows flexibility and lower costs in manufacturing. The metallic insert 150 acts as a spline for the wrench 110.

The formed metallic insert 150 has a thin neck portion 152. This allows the head 114 of the wrench 110 to be feathered back and forth. The head 154 of metallic insert 150 is shaped to receive the ratchet mechanism. The ratchet mechanism and head 154 are identical to those shown in and described with respect to FIG. 3. There are also two bolt holes 164 disposed in the head 154 of the metallic insert 150. The bolt holes 164 are used for receiving the headed bolts 126 as shown in FIG. 3. When assembled, the headed bolts 126 are threadedly engaged with bolt holes 164. The neck 152 of the metallic insert 150 is narrower than the head 154. The handle 166 of the metallic insert 150 is wider than the neck 152, but not as wide as the head 154. The rear portion of the handle 166 is cylindrical in shape.

Figure 11A:
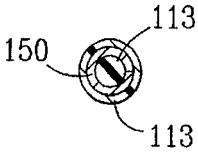
FIG. 11A illustrates a cross-sectional view along the line 11A—11A of FIG. 9.

Referring now to FIG. 11A, there is illustrated a cross-sectional view along the line 11A—11A of FIG. 9. The formed metallic insert 150 is shown having a cylindrical shape with the ends bent towards and touching each other. The ends may be welded together to form an enclosed and sealed cylinder. The composite material 113 is shown filling the area inside the cylinder formed by the metallic insert 150 and also the area around the outside of the metallic insert 150. The composite material 113 forms a circle around the metallic insert 50.

Figure 11B:
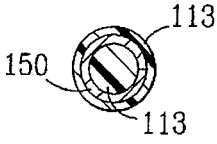
FIG. 11B illustrates a cross-sectional view along the lines 11B—11B of FIG. 11.

Referring now to FIG. 11B, there is illustrated a cross-sectional view along the lines 11B—11B of FIG. 9. The metallic insert 150 is formed in the shape of a cylinder with the ends bent towards each other. The composite material 113 is formed in the shape of a circle around the cylindrical-shaped metallic insert 150.

In summary, there has been provided a reversible drive ratchet wrench formed of a composite material. The ratchet wrench has a head and a handle. A single piece insert is provided for forming both a supportive portion of the head and a supportive portion of the handle and having a thickness substantially less than the overall thickness of the head of the ratchet, the head portion forming a cup having an opening for the ratchet mechanisms. A non-metallic material covering is provided which is molded around the formed metallic insert and encapsulating the insert. The non-metallic material may be a composite. The entire length of the insert is covered, leaving the interior of the opening for the ratchet mechanism. The insert may be made of metal. The insert may have a uniform or varying thickness. The cross-sectional shape of the insert is concave. The most distal end of the insert is smaller than the head with a narrow neck deposited between the distal end and the cup. The composite non-metallic covering may be injection or compression molded around the insert. The composite non-metallic covering may have a low dielectric value. Glass fibers may be distributed in the non-metallic covering in a longitudinal fashion. The composite non-metallic material may comprise a nylon, carbon or a copolymer. The composite covering may be uniform in thickness and vary between 0.075 inches thick and 0.090 inches or may vary greatly in thickness.

Although the preferred embodiment has been described in detail, it should be understood that various changes, substitutions and alterations can be made therein without departing from the spirit and scope of the invention as defined by the appended claims.

What is claimed is:

1. A reversible drive ratchet wrench having a head and a handle which are connected together by an intermediately disposed unitary body, comprising:

a single piece insert formed of a singular piece of metal and extending substantially the full length of said ratchet wrench, from the distal end of said handle to said head, to define a supporting handle portion of said handle, a neck portion of said unitary body and a supportive head portion of said head, said singular piece of metal having a thickness which is substantially less than an overall thickness of said handle prior to forming said singular piece of metal into said single piece insert;

said supportive head portion of said single piece insert defining a peripheral wall portion and a base portion of a cup having an opening which is disposed within said wall portions and adjacent to said base portion;

a ratchet mechanism disposed in said cup;

a clamp plate extending across said opening of said cup, opposite of said base portion, with said ratchet mechanism disposed therebetween;

said single piece insert having a multiplicity of cross-sectional shapes which vary along said full tenth of said ratchet, from a wide cross-section at said supportive head portion which is widely sized relative to other cross-sections of said single piece insert, to a thin cross-section at said neck portion which is thinly sized relative to said wide cross section of said supportive head portion and to an intermediately widened cross-section at said supporting handle portion which is intermediately sized relative to said wide cross-section of said supportive head portion and said thin cross-section of said neck portion;

said thin cross-section of said neck portion of said single piece insert being formed into a first concave shape such that said neck portion provides the primary load bearing means between said head and said handle of said ratchet wrench;

said intermediately widened cross-section of said supporting handle portion of said single piece insert being formed into a second concave shape having a contoured exterior profile; and a non-metallic, moldable covering, said covering molded around said metallic insert and encapsulating said head and said full length of said metallic insert except for said opening for said ratchet mechanism, and said covering molded around said supporting handle portion of said single piece insert to have a substantially uniform thickness along at least one side of said contoured exterior profile of said supporting handle portion to define an ergonomic style grip for said handle.

2. The wrench of claim 1, wherein said non-metallic, moldable covering is comprised of a composite material.

3. The wrench of claim 1, wherein said multiplicity of cross-sectional shapes of said single piece insert comprises:

a squared C-shape at said wide cross-section of said supportive head, wherein said peripheral wall portion and said base portion are flat and disposed at right angles to one another;

a rounded C-shape at said thin cross-section of said necked down portion, wherein opposite edges of sides of said single piece insert are closely spaced such that said opposite edges are at least almost touching; and at least one of an elongated hexagonal shape and a parabolic shape at said intermediately widened cross-section of said handle.

4. The wrench of claim 1, wherein said insert has a uniform thickness.

5. The wrench of claim 1, wherein said insert has a non-uniform thickness.

6. The wrench of claim 1, wherein said handle portion of said insert has a cross-section shape that is concave.

7. The wrench of claim 1, wherein said handle portion of said insert has a cross-section shape that is circular.

8. The wrench of claim 1, wherein said insert has a shape that is smaller than the head at the most distal end thereof, with a narrower neck region deposited between the most distal end and said cup.

9. The wrench of claim 1, wherein said non-metallic covering is injection-molded around said insert.

10. The wrench of claim 2 wherein said non-metallic covering is compression-molded around said insert.

11. The wrench of claim 1 wherein said non-metallic covering has a low dielectric value.

12. The wrench of claim 1, wherein said non-metallic covering further comprises glass fibers distributed longitudinally in said non-metallic covering.

13. The wrench of claim 1, wherein said non-metallic covering comprises nylon.

14. The wrench of claim 1, wherein said non-metallic covering comprises a copolymer.

15. The wrench of claim 1, wherein said non-metallic covering comprises a carbon composite.

16. The wrench of claim 1, wherein said non-metallic covering is between 0.075 inches thick and 0.090 inches thick.

17. The wrench of claim 1, and further comprising a non-metallic switch for switching the drive direction of the ratchet wrench, such that said switch will not conduct electricity.

18. The wrench of claim 1, wherein said formed metallic insert has a base and an oval wall around the head portion of the ratchet wrench.

19. The wrench of claim 1, wherein said cross-section of said metallic insert is "C"-shaped along the handle of the wrench.

20. The wrench of claim 1, wherein said metallic insert is cylindrical-shaped along the handle of the wrench.

21. The wrench of claim 1, wherein the cross-section of said metallic insert is parabolic-shaped along the handle of the wrench.

22. The wrench of claim 1, wherein said non-metallic covering has a smooth finish.

23. The wrench of claim 1, wherein said non-metallic covering has a textured finish.

24. The wrench of claim 1, wherein said non-metallic covering has a rubberized surface.

25. The wrench of claim 24, wherein said rubberized surface is inlaid in said non-metallic covering.

26. The wrench of claim 24, wherein said rubberized surface is molded-over in said non-metallic covering.

27. The wrench of claim 24, wherein said rubberized surface is bonded-to said non-metallic covering.

28. The wrench of claim 1, wherein said non-metallic covering is of a uniform thickness on all parts of said formed metallic insert.

29. The wrench of claim 1, wherein said non-metallic covering is of differing thicknesses over different parts of said formed metallic insert.

30. The wrench of claim 1, wherein said non-metallic covering is contoured.

31. A method for forming a reversible drive ratchet wrench having a head and a handle connected together by a unitary body portion, comprising the steps of:

providing a singular piece of metal, a non-metallic covering and a ratchet mechanism;

forming the singular piece of metal into a single piece insert which extends with a multiplicity of cross-sectional shapes substantially along the full length of the ratchet wrench, wherein a supportive head portion of the head is formed having a wide cross-section which defines a cup having an opening, said wide cross-section being widely sized relative to other cross-sections of said single piece insert, a neck portion of said unitary body is formed having a thin cross-section relative to said wide cross-section, and a supporting handle portion of the handle is formed having an intermediately widened cross-section relative to said wide cross-section and said thin cross-section, wherein said singular piece of metal has a thickness which is substantially less than an overall thickness of the handle prior to forming the singular piece of metal into the single piece insert;

wherein said thin cross-section of said neck portion of said single piece insert is formed into a first concave shape such that said neck portion provides the primary load bearing means between said head and said handle of said ratchet wrench:

wherein said intermediately widened cross-section of said supporting handle portion of said single piece insert is formed into a second concave shape having a contoured exterior profile;

disposing a ratchet mechanism in the cup; and molding a non-metallic covering around the metallic insert and encapsulating the head and the entire length of the metallic insert except for the opening for the ratchet mechanism, wherein said non-metallic covering is molded around said supporting handle portion of said single piece insert to have a substantially uniform thickness along at least one side of said contoured exterior profile of said supporting handle portion to define an ergonomic style grip for said handle.

32. The method of claim 31, wherein said non-metallic covering comprises a composite.

33. The method of claim 31, wherein said step of forming said single piece insert into a multiplicity of cross-sectional shapes comprises:

forming the wide cross-section of the supportive head portion into a squared C-shape, wherein oppositely disposed surfaces of the peripheral wall portion are substantially parallel;

forming the thin cross-section of the necked down portion into a rounded C-shape, wherein opposite edges of sides of the single piece insert are closely spaced such that the opposite edges are at least almost touching; and forming the intermediately widened cross-section of the handle into at least one of an elongated hexagonal shape and a parabolic shape.

34. The method of claim 31, wherein the insert has a uniform thickness.

35. The method of claim 31, wherein the insert has a non-uniform thickness.

36. The method of claim 31, wherein the handle portion of the insert has a cross-section shape that is concave.

37. The method of claim 31, wherein the handle portion of the insert is cylindrical-shaped.

38. The method of claim 31, wherein the insert has a shape that is smaller than the head at the most distal end thereof, with a narrower neck region disposed between the most distal end and the cup.

39. The method of claim 31, wherein the non-metallic covering is injection-molded around the insert.

40. The method of claim 31, wherein the non-metallic covering is compression-molded around the insert.

41. The method of claim 31, wherein the non-metallic covering has a low dielectric value.

42. The method of claim 31, and further comprising the step of distributing glass fibers longitudinally in the non-metallic covering.

43. The method of claim 31, wherein the non-metallic covering comprises a nylon.

44. The method of claim 31, wherein the non-metallic covering comprises a copolymer.

45. The method of claim 31, wherein the non-metallic covering comprises a carbon composite.

46. The method of claim 31, wherein the non-metallic covering is between 75/1000 of an inch thick and 90/1000 of an inch thick.

47. The method of claim 31, and further comprising the step of disposing a non-metallic switch on the wrench for switching the drive direction of the ratchet wrench, such that the composite switch will not conduct electricity.

48. The method of claim 31, wherein the formed metallic insert has a base and an oval wall around the head portion of the ratchet wrench.

49. The method of claim 31, wherein the cross-section of the metallic insert is "C"-shaped along the handle of the wrench.

50. The method of claim 31, wherein the cross-section of the metallic insert is parabolic-shaped along the handle of the wrench.

51. The method of claim 31, wherein the cross-section of the metallic insert is circular along the handle of the wrench.

52. The method of claim 31, wherein the non-metallic covering has a smooth finish.

53. The method of claim 31, wherein the non-metallic covering has a textured finish.

54. The method of claim 31, wherein the non-metallic covering has a rubberized surface.

55. The method of claim 54, and further comprising the step of inlaying the rubberized surface in the non-metallic covering.

56. The method of claim 54, and further comprising the step of molding the rubberized surface over the non-metallic covering.

57. The method of claim 54, and further comprising the step of bonding the rubberized surface to the non-metallic covering.

58. The method of claim 31, wherein the non-metallic covering is of a uniform thickness on all parts of the formed metallic insert.

59. The method of claim 31, wherein the non-metallic covering is of differing thicknesses over different parts of the formed metallic insert.

60. The method of claim 31, wherein the non-metallic covering is contoured.

* * * * *